US011761703B2

(12) United States Patent
Eddy et al.

(10) Patent No.: US 11,761,703 B2
(45) Date of Patent: Sep. 19, 2023

(54) PARALLEL LOOP INTERMODAL CONTAINER

(71) Applicant: Carrier Corporation, Palm Beach Gardens, FL (US)

(72) Inventors: Renee A. Eddy, Manlius, NY (US); Jeffrey J. Burchill, Baldwinsville, NY (US); Giorgio Rusignuolo, Manlius, NY (US); Robert A. Chopko, Baldwinsville, NY (US); Larry D. Burns, Avon, IN (US); Ciara N. Poolman, Syracuse, NY (US); Paul Papas, West Hartford, CT (US); Ivan Rydkin, Rochester, NY (US)

(73) Assignee: Carrier Corporation, Palm Beach Gardens, FL (US)

( * ) Notice: Subject to any disclaimer, the term of this patent is extended or adjusted under 35 U.S.C. 154(b) by 712 days.

(21) Appl. No.: 15/774,735

(22) PCT Filed: Nov. 9, 2016

(86) PCT No.: PCT/US2016/061058
§ 371 (c)(1),
(2) Date: May 9, 2018

(87) PCT Pub. No.: WO2017/083333
PCT Pub. Date: May 18, 2017

(65) Prior Publication Data

US 2018/0347896 A1 Dec. 6, 2018

Related U.S. Application Data

(60) Provisional application No. 62/253,077, filed on Nov. 9, 2015.

(51) Int. Cl.
*F25D 29/00* (2006.01)
*F25B 49/00* (2006.01)
(Continued)

(52) U.S. Cl.
CPC ..... *F25D 29/008* (2013.01); *F25B 9/002* (2013.01); *F25B 49/005* (2013.01);
(Continued)

(58) Field of Classification Search
CPC .... F25B 9/002; F25B 49/005; F25B 2400/06; F25B 2400/121; F25B 2400/21;
(Continued)

(56) References Cited

U.S. PATENT DOCUMENTS 2,881,600 A * 4/1959 Elfving ..... F25D 11/003 62/239
3,688,846 A 9/1972 Lease
(Continued)

FOREIGN PATENT DOCUMENTS

CN 1392944 A 1/2003
CN 1607123 A 4/2005
(Continued)

OTHER PUBLICATIONS

English Translation of König (Year: 2020).*
(Continued)

*Primary Examiner* — Joseph F Trpisovsky
(74) *Attorney, Agent, or Firm* — Bachman & LaPointe, P.C.

(57) ABSTRACT

A refrigerated transport system comprises a body enclosing a refrigerated compartment. A refrigeration system (29) comprises first and second vapor compression loops each having: a refrigerant charge; a compressor (36A,B) for driving the refrigerant of the refrigerant charge; a first heat exchanger (38A,B) positioned to reject heat to an external environment in a cooling mode; and a second heat exchanger (42A,B) positioned to absorb heat from the refrigerated compartment in the cooling mode.

19 Claims, 7 Drawing Sheets

(51) Int. Cl.

| | |
|---|---|
| ***F25D 11/00*** | (2006.01) |
| ***F25D 19/04*** | (2006.01) |
| ***F25B 9/00*** | (2006.01) |

(52) U.S. Cl.

CPC ..... *F25D 11/003* (2013.01); *F25D 19/04* (2013.01); *F25D 29/006* (2013.01); *F25B 2400/06* (2013.01); *F25B 2400/121* (2013.01); *F25B 2400/21* (2013.01); *F25B 2500/222* (2013.01); *F25D 29/003* (2013.01)

(58) Field of Classification Search

CPC .. F25B 2500/222; F25D 11/003; F25D 19/04; F25D 29/008; F25D 29/006; F25D 29/003

See application file for complete search history.

(56) References Cited

U.S. PATENT DOCUMENTS

| | | | | |
|---|---|---|---|---|
| 3,886,535 | A | 5/1975 | Cirincione | |
| 4,553,584 | A * | 11/1985 | Bloomquist | F25D 17/06 165/263 |
| 4,797,254 | A | 1/1989 | Seidel | |
| 5,065,587 | A | 11/1991 | Howland et al. | |
| 5,364,262 | A | 11/1994 | Phillips | |
| 5,438,841 | A | 8/1995 | Cahill-O'Brien et al. | |
| 5,457,963 | A | 10/1995 | Cahill-O'Brien et al. | |
| 5,507,539 | A | 4/1996 | Basinski | |
| 5,610,398 | A | 3/1997 | Anderson et al. | |
| 5,918,475 | A | 7/1999 | Sakakibara et al. | |
| 6,085,531 | A | 7/2000 | Numoto et al. | |
| 7,145,788 | B2 | 12/2006 | Plummer | |
| 7,150,159 | B1 | 12/2006 | Brummett et al. | |
| 7,673,466 | B2 | 3/2010 | Pacy | |
| 8,051,882 | B2 | 11/2011 | Koeninger et al. | |
| 8,820,102 | B2 | 9/2014 | Shiraishi et al. | |
| 8,935,933 | B1 | 1/2015 | Koelsch | |
| 9,033,116 | B2 | 5/2015 | Breed | |
| 9,121,634 | B2 | 9/2015 | Rogers et al. | |
| 2002/0178738 | A1 * | 12/2002 | Taira | F24F 11/89 62/129 |
| 2003/0136879 | A1 | 7/2003 | Grabow et al. | |
| 2003/0213254 | A1 | 11/2003 | Koo | |
| 2004/0020228 | A1 * | 2/2004 | Waldschmidt | F25D 21/06 62/276 |
| 2004/0055345 | A1 | 3/2004 | Moore | |
| 2004/0084193 | A1 | 5/2004 | Tseng | |
| 2005/0086952 | A1 | 4/2005 | Nonaka et al. | |
| 2007/0074528 | A1 * | 4/2007 | Rodriguez | F25D 11/003 62/371 |
| 2009/0205846 | A1 | 8/2009 | Zeweke et al. | |
| 2009/0288438 | A1 | 11/2009 | Viegas | |
| 2010/0147006 | A1 | 6/2010 | Taras et al. | |
| 2011/0247350 | A1 | 10/2011 | Awwad et al. | |
| 2012/0119136 | A1 * | 5/2012 | Yana Motta | C09K 5/045 252/67 |
| 2012/0139470 | A1 * | 6/2012 | Huff | F25D 11/003 318/739 |
| 2012/0168184 | A1 | 7/2012 | Enk, Sr. | |
| 2013/0186126 | A1 * | 7/2013 | Morimoto | F25B 13/00 62/324.6 |
| 2013/0213068 | A1 | 8/2013 | Goel et al. | |
| 2014/0130528 | A1 | 5/2014 | Morimoto et al. | |
| 2014/0260404 | A1 | 9/2014 | Verma et al. | |
| 2014/0338374 | A1 | 11/2014 | Cresswell et al. | |
| 2015/0257549 | A1 | 9/2015 | Shaprio et al. | |
| 2015/0316521 | A1 | 11/2015 | Goldman | |
| 2016/0101674 | A1 | 4/2016 | Rivière et al. | |
| 2016/0272047 | A1 | 9/2016 | Gan | |
| 2017/0159990 | A1 * | 6/2017 | Kim | F25D 11/022 |

FOREIGN PATENT DOCUMENTS

| | | | | |
|---|---|---|---|---|
| CN | 101583833 | A | 11/2009 | |
| CN | 101595353 | A | 12/2009 | |
| CN | 103733005 | A | 4/2014 | |
| CN | 104477004 | A | 4/2015 | |
| CN | 204671777 | U | 9/2015 | |
| DE | 102011108020 | A1 | 4/2012 | |
| DE | 102014205005 | A1 | 9/2015 | |
| EP | 0276054 | B1 | 8/1990 | |
| EP | 0686744 | A2 | 12/1995 | |
| EP | 1512565 | A1 * | 3/2005 | B60H 1/3232 |
| EP | 2284460 | A1 | 2/2011 | |
| GB | 1132151 | A | 10/1968 | |
| JP | 08266659 | A | 10/1996 | |
| JP | 10103838 | A | 4/1998 | |
| JP | 2000105034 | A | 4/2000 | |
| JP | 2001082816 | A | 3/2001 | |
| JP | 2004286363 | A | 10/2004 | |
| JP | 2004286363 | A * | 10/2004 | B60H 1/3232 |
| JP | 2005090917 | A | 4/2005 | |
| JP | 2005233577 | A | 9/2005 | |
| JP | 2006273413 | A | 10/2006 | |
| JP | 2007212113 | A | 8/2007 | |
| JP | 2014145586 | A | 8/2014 | |
| KR | 20020049553 | A | 6/2002 | |
| TW | 590926 | B | 6/2004 | |
| WO | WO-0223100 | A1 * | 3/2002 | C09K 5/045 |
| WO | 2008/033570 | A2 | 3/2008 | |
| WO | 2011/055163 | A1 | 5/2011 | |
| WO | 2014152349 | A1 | 9/2014 | |
| WO | 2014179013 | A1 | 11/2014 | |
| WO | 2015/009721 | A1 | 1/2015 | |
| WO | 2015032905 | A1 | 3/2015 | |
| WO | WO-2015032905 | A1 * | 3/2015 | F25D 29/008 |
| WO | 2015/057298 | A1 | 4/2015 | |
| WO | 2015/057299 | A1 | 4/2015 | |
| WO | 2015057297 | A1 | 4/2015 | |
| WO | 2017/083334 | A1 | 5/2017 | |
| WO | 2017/083336 | A1 | 5/2017 | |

OTHER PUBLICATIONS

English Translation of JP2004286363 (Year: 2021).*

English Translation of WO2015032905 (Year: 2020).*

Machine translation for WO 0223100 (Year: 2002).*

Chinese Office Action dated Dec. 4, 2019 for Chinese Patent Application No. 201680065396.5.

International Search Report and Written Opinion dated Mar. 23, 2017 for PCT Patent Application No. PCT/US2016/061058.

Singapore Office Action dated Aug. 19, 2019 for Singapore Patent Application No. 11201803311V.

Chinese Office Action dated Nov. 26, 2019 for Chinese Patent Application No. 201680065410.1.

Container Parts Catalogue, Dec. 10, 2012, Gavan, Sydney, Australia.

Spec Sheet, Presenting the new NFI Intermodal RoadRail state-of-the-art refrigerated container, Dec. 27, 2010, NFI Intermodal, Cherry Hill, New Jersey.

Case Study, Ice Cream Manufacturer counts on NFI Intermodal RoadRail's New Refrigerated Containers to Deliver Product at −20F On Time, Dec. 27, 2010, NFI Intermodal, Cherry Hill, New Jersey.

International Search Report and Written Opinion dated Jan. 20, 2017 for PCT Patent Application No. PCT/US2016/061061.

International Search Report and Written Opinion dated Feb. 22, 2017 for PCT Patent Application No. PCT/US2016/061059.

U.S. Office Action dated Oct. 16, 2019 for U.S. Appl. No. 15/774,740.

Singapore Search Report and Written Opinion dated Aug. 14, 2019 for Singapore Patent Application No. 11201803700X.

Singapore Search Report and Written Opinion dated Sep. 6, 2019 for Singapore Patent Application No. 11201803405Q.

U.S. Office Action dated Oct. 16, 2019 for U.S. Appl. No. 15/774,750.

Chinese Office Action dated Aug. 17, 2020 for Chinese Patent Application No. 201680065396.5.

(56) References Cited

OTHER PUBLICATIONS

Singapore Office Action dated Jul. 15, 2020 for Singapore Patent Application No. 11201803311V.
European Office Action dated Apr. 23, 2020 for European Patent Application No. 16798611.6.
European Office Action dated Jan. 22, 2021 for European Patent Application No. 16798611.6.

* cited by examiner

PARALLEL LOOP INTERMODAL CONTAINER

CROSS-REFERENCE TO RELATED APPLICATION

Benefit is claimed of U.S. Patent Application No. 62/253,077, filed Nov. 9, 2015, and entitled "Parallel Loop Intermodal Container", the disclosure of which is incorporated by reference herein in its entirety as if set forth at length.

BACKGROUND

The disclosure relates to refrigerated transport systems such as intermodal containers. More particularly, the disclosure relates to refrigerant safety in such refrigerated transport systems.

An exemplary refrigerated intermodal container (also known as a shipping container or intermodal shipping container) has an equipment module at one end of the container. The equipment module contains a vapor compression system having a compressor, a heat rejection heat exchanger downstream of the compressor along a refrigerant flow path, an expansion device, and a heat absorption heat exchanger. One or more first fans may drive an external air flow across the heat rejection heat exchanger. One or more second fans may drive an internal air flow across the heat absorption heat exchanger. In various implementations, for powering the container, there may be a power cord for connecting to an external power source. For ease of manufacture or service, the equipment module may be pre-formed as a module mateable to a remainder of the container body (e.g., insertable into an open front end of the body). One example of such a container refrigeration system is sold by Carrier Corporation of Farmington, Conn. under the trademark ThinLINE. An example of such a system is seen in U.S. Patent Application 62/098,144, of Rau, filed Dec. 30, 2014 and entitled "Access Panel", the disclosure of which is incorporated in its entirety herein as if set forth at length. Additionally, refrigerated truck boxes, refrigerated railcars, and the like may have refrigeration systems with different forms or degrees of modularity.

There has been a general move to seek low global warming potential (GWP) refrigerants to replace conventional refrigerants such as R-134a. A number of proposed and possible future replacement refrigerants having low GWP also may have higher flammability and/or toxicity levels than prior refrigerants. These include various hydrofluorocarbon (HFC) and hydrocarbon (HC) refrigerants. Background flame arrestor technology for use with flammable refrigerants is found International Publication No. WO2015/009721A1, published Jan. 22, 2015, the disclosure of which is incorporated herein in its entirety by reference as if set forth at length.

SUMMARY

One aspect of the disclosure involves a refrigerated transport system such as an intermodal container comprising a body enclosing a refrigerated compartment. A refrigeration system comprises first and second vapor compression loops each having: a refrigerant charge; a compressor for driving the refrigerant of the refrigerant charge; a first heat exchanger positioned to reject heat to an external environment in a cooling mode; and a second heat exchanger positioned to absorb heat from the refrigerated compartment in the cooling mode.

In one or more embodiments of any of the foregoing embodiments, for each of the first vapor compression loop and the second vapor compression loop an electric fan is positioned to drive a recirculating air flow from the refrigerated compartment across the second heat exchanger.

In one or more embodiments of any of the foregoing embodiments, for each of the first vapor compression loop and the second vapor compression loop the refrigerant charge of the vapor compression loop is mildly flammable.

In one or more embodiments of any of the foregoing embodiments, for each of the first vapor compression loop and the second vapor compression loop the refrigerant charge of the vapor compression loop comprises at least 50% by weight one or a combination of R-1234ze(E), R-32, R-1234yf.

In one or more embodiments of any of the foregoing embodiments, for each of the first vapor compression loop and the second vapor compression loop the refrigerant charge of the vapor compression loop comprises at least 30% by weight one of R-1234ze(E), R-32, R-1234yf.

In one or more embodiments of any of the foregoing embodiments, for each of the first vapor compression loop and the second vapor compression loop the refrigerant charge of the vapor compression loop comprises at least 50% by weight one of R-1234ze(E), R-32, R-1234yf.

In one or more embodiments of any of the foregoing embodiments, for each of the first vapor compression loop and the second vapor compression loop the refrigerant charge has a mass of not more than 2.0 kg.

In one or more embodiments of any of the foregoing embodiments, the first vapor compression loop and the second vapor compression loop are not in refrigerant communication with each other.

In one or more embodiments of any of the foregoing embodiments, the refrigeration system is mounted in an equipment box at a second end of the body opposite the first end.

In one or more embodiments of any of the foregoing embodiments, a single generator powers the compressor of the first vapor compression loop and the compressor of the second vapor compression loop.

In one or more embodiments of any of the foregoing embodiments, the refrigerated transport system further comprises a detector for detecting leakage of the refrigerant.

In one or more embodiments of any of the foregoing embodiments, a locking mechanism has a first condition locking the doors and a second condition allowing opening of the doors and coupled to the detector.

In one or more embodiments of any of the foregoing embodiments, the locking mechanism is coupled to the detector to shift from the second condition to the first condition responsive to detection by the detector of the refrigerant outside the refrigerant flowpaths.

In one or more embodiments of any of the foregoing embodiments, the refrigerated transport system further comprises one or both of: an externally visible light coupled to the detector; and an externally audible alarm coupled to the detector.

In one or more embodiments of any of the foregoing embodiments, the refrigerated transport system further comprises a battery-powered ventilation fan.

In one or more embodiments of any of the foregoing embodiments, the refrigerated transport system further comprises for each of the first vapor compression loop and the second vapor compression loop: a first electric fan positioned to drive an air flow across the first heat exchanger;

and a second electric fan positioned to drive a recirculating air flow from the refrigerated compartment across the second heat exchanger.

In one or more embodiments of any of the foregoing embodiments, the detector comprises a non-dispersive infrared sensor.

In one or more embodiments of any of the foregoing embodiments, the refrigerated transport system is a refrigerated intermodal shipping container wherein: the one or more doors comprise a pair of hinged doors at a first end of the body; and the refrigeration system is mounted in an equipment box at a second end of the body opposite the first end.

In one or more embodiments of any of the foregoing embodiments, a controller is coupled to the detector so as to, responsive to said detecting leakage of the refrigerant, at least one of: vent the refrigerated compartment; lock at least one door of the one or more doors; isolate a portion of the refrigeration flowpath; and provide an audible and/or visible indication of the detection.

In one or more embodiments of any of the foregoing embodiments, a method for operating the refrigerated transport system comprises: responsive to said detecting leakage of the refrigerant, at least one of: venting the refrigerated compartment; locking at least one door of the one or more doors; isolating a portion of the refrigeration flowpath; and providing an audible and/or visible indication of the detection.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
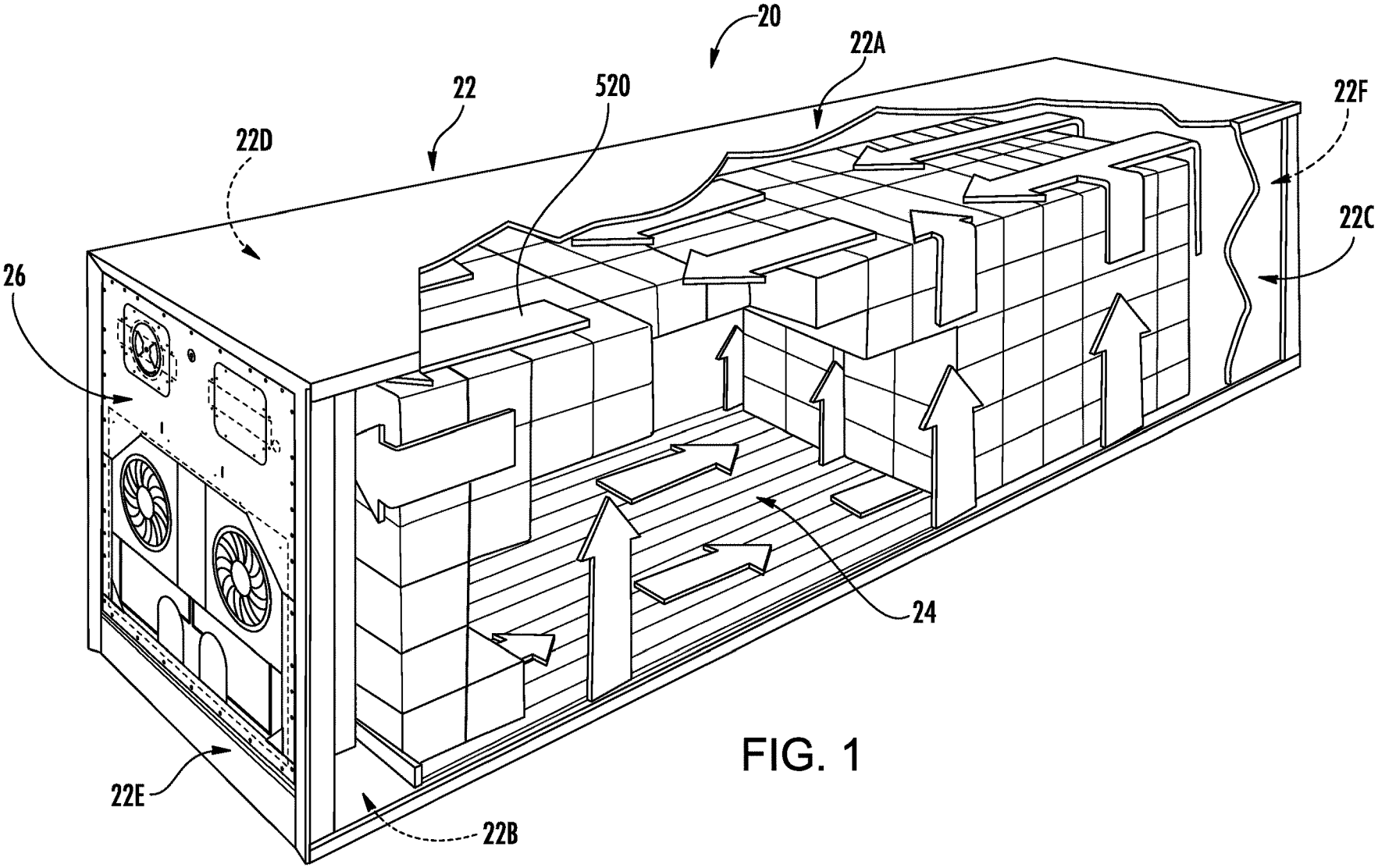
FIG. 1 is a cutaway view of a refrigerated cargo container.
Figure 2:
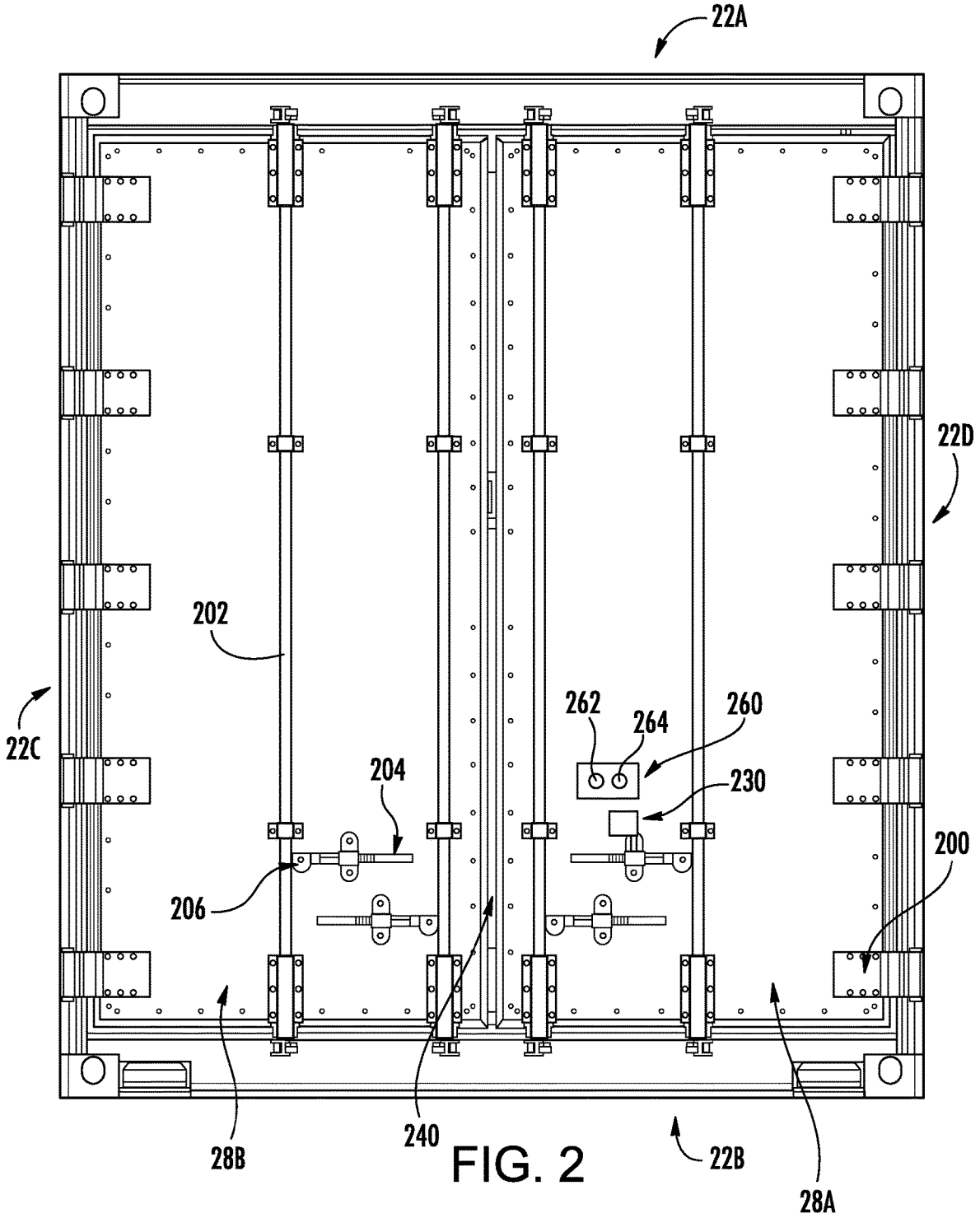
FIG. 2 is a rear view of the refrigerated cargo container.

FIG. 1 shows an intermodal container 20 that may be shipped, trucked, trained or the like. The container has a body 22 enclosing an interior 24. The body 22 and interior 24 are formed essentially as right parallelepipeds. The body 22 has a top 22A, a bottom 22B, a first side 22C, a second side 22D, a first end 22E and a second end 22F. The top, bottom, and sides may be an integral rigid metallic structural system. The first end may be closed by an equipment module 26 ("equipment box"). The second end may essentially be formed by a pair of oppositely hinged doors 28A, 28B (FIG. 2).

Figure 3:
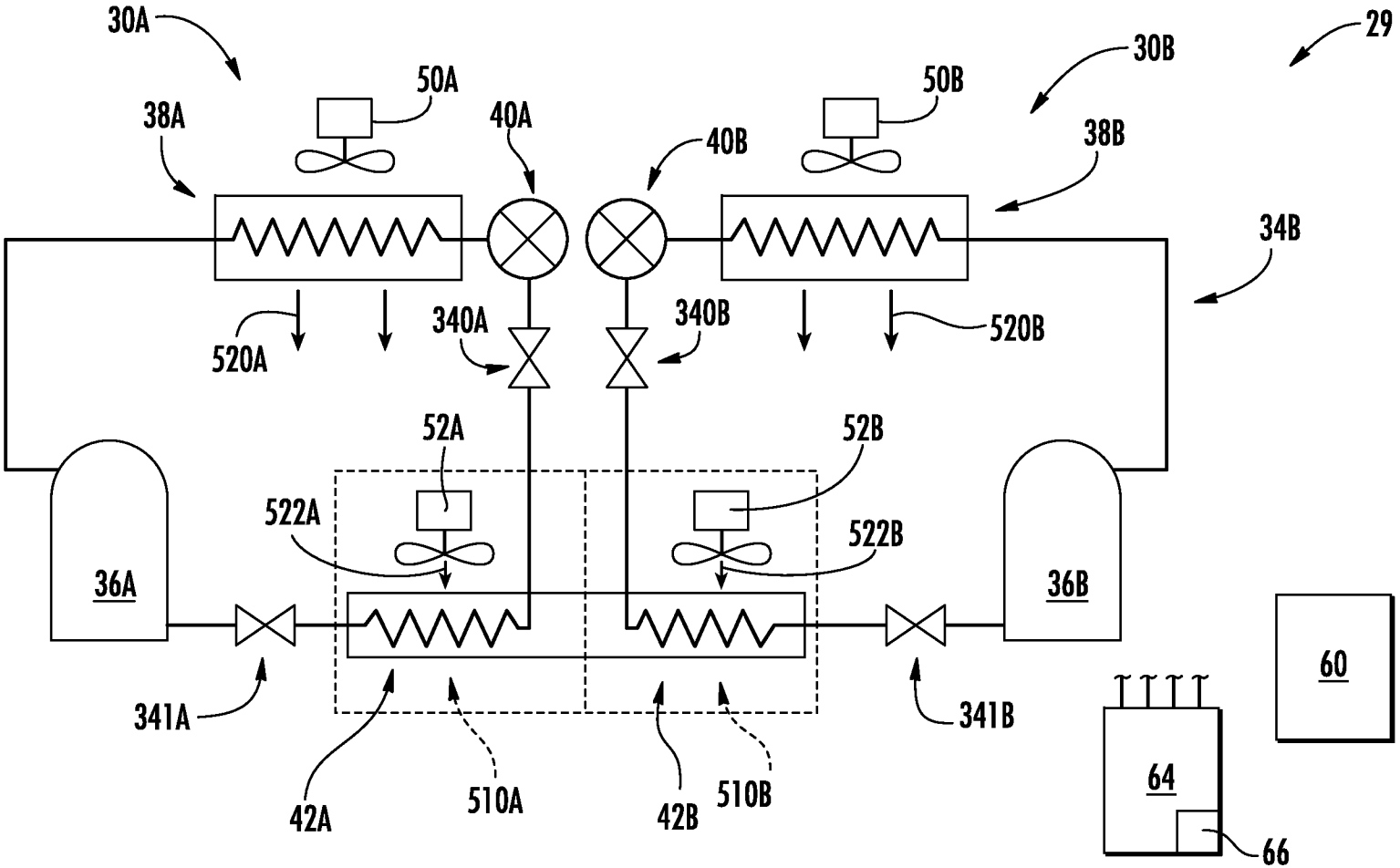
FIG. 3 is a schematic view of a refrigeration system of the refrigerated cargo container.

The equipment module contains a vapor compression refrigeration system 29 (FIG. 3) comprising first and second vapor compression (sub) systems (loops) 30A, 30B. In the illustrated example, each loop 30A, 30B comprises, sequentially along a refrigerant flowpath 34A, 34B, a compressor 36A, 36B, a heat rejection heat exchanger 38A, 38B, an expansion device 40A, 40B (e.g., electronic expansion valve, thermal expansion valve, orifice, or the like), and a heat absorption heat exchanger 42A, 42B. For each loop, one or more first fans 50A, 50B may drive an external air flow 520A, 520B across the heat rejection heat exchanger. For each loop, one or more second fans 52A, 52B (FIGS. 3 and 4) may drive an internal air flow 522A, 522B along respective flowpaths 510A, 510B across the heat absorption heat exchanger.

In various implementations, for powering the container, there may be a power cord (e.g., a single cord common to (shared by) the two loops 30A, 30B, not shown) for connecting to an external power source. Additionally, the container may be associated with a generator 60 (FIG. 3, e.g., also common to (shared by) the two loops and having an internal combustion engine). For intermodal containers, the generator may be a part of an accessory "genset" that may separately mount to a vehicle (trailer or rail car) carrying the container. Other transport refrigeration systems such as dedicated trailers may integrate the generator into an equipment body mounted to the front of the trailer box. The refrigeration system may include a main controller 64 (e.g., having a processor, memory and storage for running a program to perform the required functions and which may also be common to (shared by) the two loops) powered by a main battery 66. The battery is typically a rechargeable battery that charges when the container is plugged into external power or a running genset.

For ease of manufacture or service, the equipment module may be pre-formed as a module mateable to a remainder of the container body (e.g., insertable into an open front end of the body).

Figure 4:
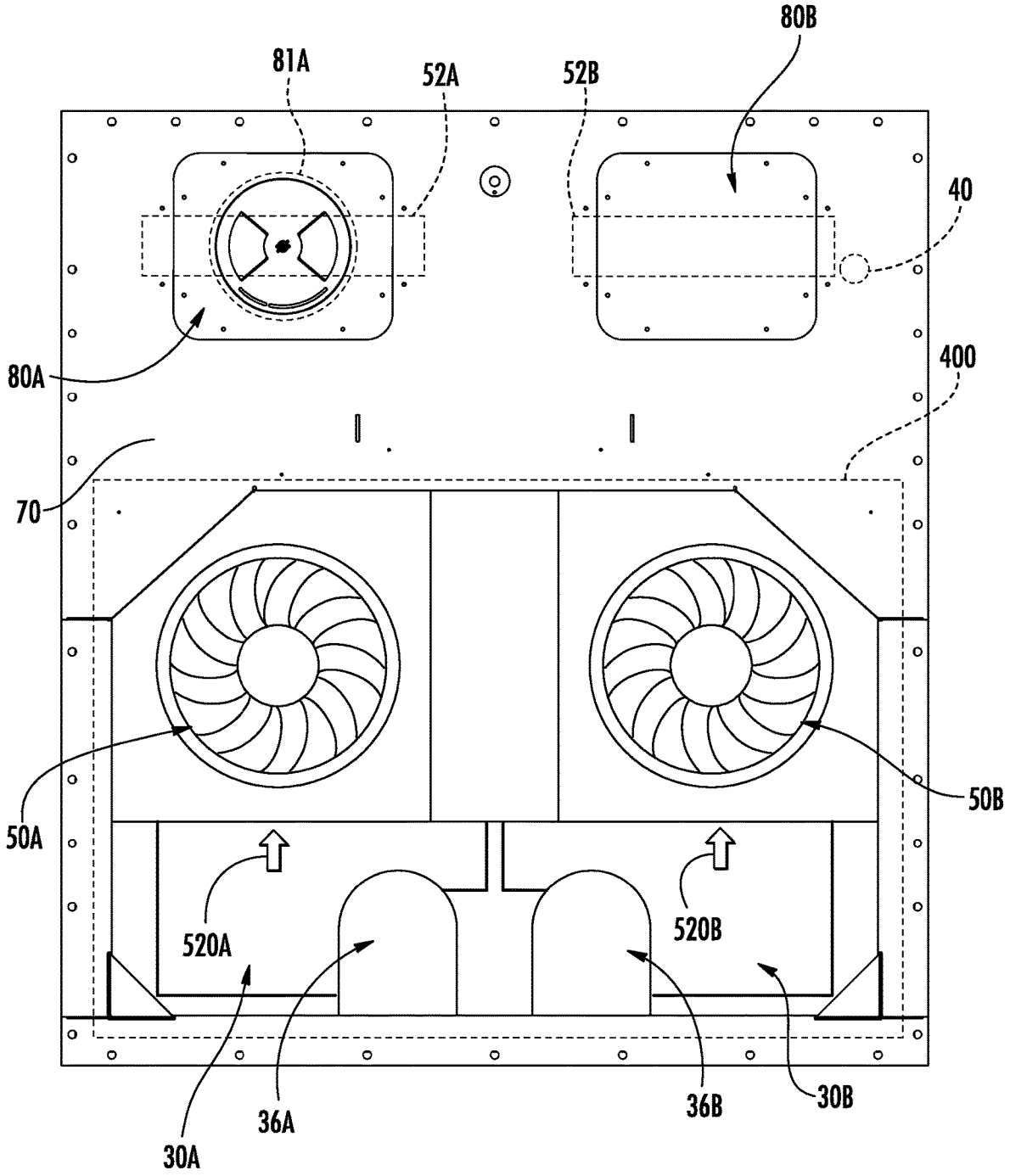
FIG. 4 is a front view of a refrigeration unit of the container of FIG. 1.

The module 26 comprises a front panel 70 (FIG. 4). The panel 70 may have a plurality of openings of which some may be closed by various means. Two of the openings are along the respective air flowpaths 510A, 510B of the two evaporator fans 52A and 52B. These flowpaths may be isolated from each other or may merely be adjacent halves of a single flowpath (or may be a combination, separating and merging). In this example, the opening spans the fan, so that a portion of the opening is upstream of the fan and a portion of the opening is downstream. The openings are closed by respective access panels 80A, 80B (FIG. 4). The exemplary panel 80A includes a rotary gate valve (e.g., motorized) for venting for fresh air exchange. It may also have a small blower fan 81A to withdraw air from the flowpath 510A (or may rely on leakage across the adjacent evaporator fan). Other valve/gate structures may be provided. The illustrated panel 80B lacks any vent/valve and/or blower but may also have one.

By separating a single baseline vapor compression loop into two parallel independent loops, the amount of refrigerant that can leak is reduced. When flammable and/or toxic refrigerants are used, this potentially allows a lower level of mitigation or other measures to prevent fire, explosion, poison, and the like. A number of exemplary mitigation features are discussed below. Exemplary refrigerant charges will depend upon the type of refrigerant used, in one group of examples, the charge per loop is kept to not more than an exemplary 2.0 kg. For example based on industry standards, charges of particular mildly flammable refrigerants would be: R-32 at 1.836 kg or less; R-1234ze(E) at 1.956 kg or less; and R-1234yf at 1.734 kg or less.

The exemplary pair of rear doors 28A, 28B (FIG. 2) are hinged 200 along their outboard edges to the adjacent sides and meet at their inboard edges. To secure the doors in place, each door has a pair of vertically oriented locking bars 202 mounted in bushings for rotation about their central vertical axes. At upper and lower ends, each of the locking bars has a cam which may interact with an associated complementary keeper mounted in the rear header and rear sill respectively. The locking bars may rotate by approximately 90° or up to approximately 180° between a locked condition wherein the cams interlock with the keepers and an unlocked condition where the cams may pass free from the keepers as the doors are rotated between their opened and closed conditions.

Each of the locking bars has mounted to it a handle 204 for rotating the bar. The handle has a proximal end mounted to the bar (e.g., by a pivot bracket 206) and a distal end at a hand grip. In the locked condition, the handle lies flat along the rear surface of the associated door. The handle may be held in place by a releasable catch 220 (FIG. 6) on the door. In some implementations, a retainer 222 on the door is associated with the catch. In that situation, an unlatching action involves releasing the catch, rotating the handle slightly upward (about a pivot axis of the pivot bracket) out of engagement with the retainer, and then rotating the handle outward about the axis of the locking rod to disengage the cams from the keepers. A locking/latching motion involves the reverse. In other exemplary implementations, the handle may be nonpiviotally mounted to the locking rod so that unlocking the door does not require first raising the handle.

To address the use of hazardous or flammable refrigerant in the vapor compression system, one or more of several features may be added to a baseline (e.g., prior art) container body or included in the equipment module. Exemplary refrigerants have flammability and toxicity ratings of A3/B3, A2L/B2, or A2 under ANSFASHRAE Standard 34-2007. These include R-290 (propane) amongst other hydrocarbon refrigerants. A2L (non-toxic, mildly flammable) refrigerants include R-1234yf, R-1234ze(E), and R-32. A3 (non-toxic, highly flammable) refrigerants include propane. B2L (toxic, mildly flammable) refrigerants include ammonia. B3 (toxic, highly flammable) refrigerants include acetone and cyclopentane. The same ratings standards may be applied to refrigerant blends.

Flammable refrigerants used in HVAC/R applications may leak and migrate to undesirable regions such as confined spaces in the vicinity of the HVAC/R system. When the flammable refrigerants, in the presence of air or another oxidizer, are exposed to an ignition source, the potential for combustion events exists. The term flammability refers to the ability of a mixed refrigerant-air mixture, initially at ambient pressure and temperature conditions, to self-support flame propagation after a competent ignition source is removed. Such a flame or deflagration will propagate throughout the gaseous mixture provided that the composition of the mixture is within certain limits called the lower and upper flammability limits LFL and UFL, respectively. The LFL represents the lowest refrigerant concentration that when well-mixed with air can ignite and propagate a flame at a given initial temperature and pressure condition. Similarly, a refrigerant's upper flammability limit (UFL) represents the highest refrigerant concentration with air that can propagate a flame.

For classification of a refrigerant as flammable or nonflammable, safety standards such as ANSI/ASHRAE Standard 34 have established testing methods such as ASTM E681 *Standard Test Method for Concentration Limits of Flammability of Chemicals* (*Vapors and Gases*) using a spark ignition source.

The degree of flammability can be assigned to one of three classes (1 or nonflammable, 2 or mildly flammable, and 3 or highly flammable) based on lower flammability limit testing, heat of combustion, and the laminar burning velocity measurement. A refrigerant can be assigned Class 2 if the refrigerant meets all three of the following conditions: (1) Exhibits flame propagation when tested at 140° F. (60° C.) and 14.7 psia (101.3 kPa), (2) Has an LFL>0.0062 lb/ft$^3$ (0.10 kg/m$^3$), and (3) Has a heat of combustion <8169 Btu/lb (19,000 kJ/kg). A refrigerant can be assigned Class 3 if the refrigerant meets both of the following conditions: (1) Exhibits flame propagation when tested at 140° F. (60° C.) and 101.3 kPa (14.7 psia), (2) Has an LFL≥0.0062 lb/ft$^3$ (0.10 kg/m$^3$) or it has a heat of combustion that is ≥8169 Btu/lb (19,000 kJ/kg).

There is a need for an HVAC/R system or components that mitigates the spread of a flame upon ignition to other nearby combustible materials, mitigates the propagation of premixed deflagrations or explosions that can cause significant overpressure and structural damage or human injury in confined spaces, and/or quenches flames soon after ignition of refrigerant-air mixtures which may pose a risk to humans in the vicinity.

Figure 5:
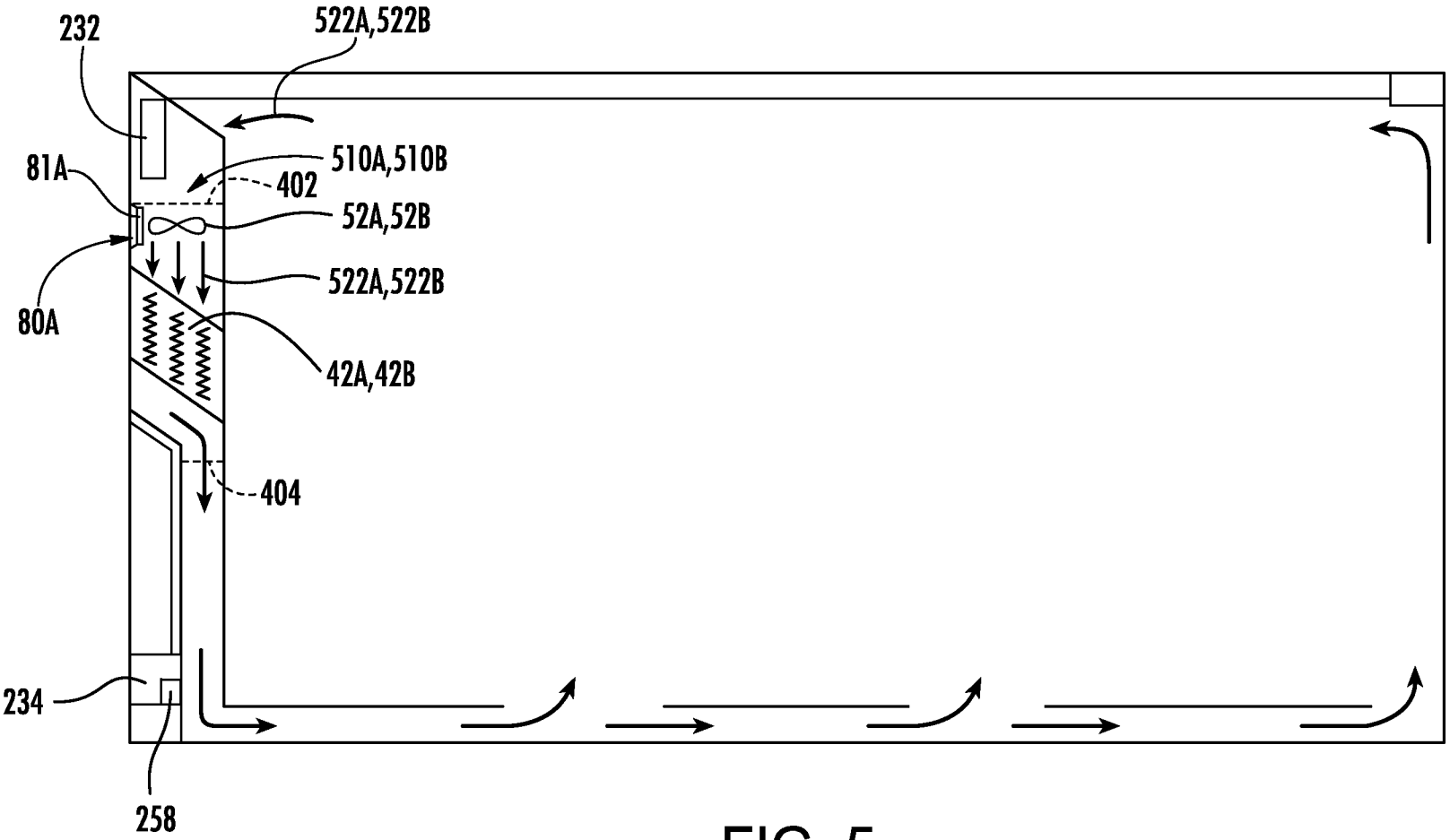
FIG. 5 is a schematic side cutaway view of the refrigerated cargo container.

The total charge may consist essentially of one or more such refrigerants (e.g., allowing for industry standard levels of contaminants and additives such as corrosion inhibitors) or at least be 30% or 50% by weight such refrigerant(s). Propane offers efficiency and low cost. It or the other refrigerants may form the base refrigerant or a minority component in a blend. Blends containing propane or other refrigerants at levels of at least 3.0 weight percent may be used. As is discussed below, however, other mildly flammable refrigerants may synergistically cooperate with the reduced charge per unit parallel loop configuration to allow lesser mitigation requirements and offset costs of the extra loop A first feature is an electronically or electrically controlled supplemental locking mechanism (lock) 230 which may be added to act responsive to detecting of a refrigerant leak by a detector 232 (FIG. 5). The detector is positioned to detect the presence of refrigerant in the interior of the container (particularly in the refrigerated compartment). A number of possible locations exist for such a detector including locations within the equipment box (e.g., adjacent the evaporator in a duct along one of the flowpaths 510A or 510B either inside or outside the equipment module communicating with the rest of the refrigerated compartment or space) or more remote (e.g., even as far away as on or adjacent the doors).

Exemplary detectors comprise infrared sensors along with signal processing and output electronics as may be appropriate. Exemplary infrared sensors are non-dispersive infrared (NDIR) sensors. Exemplary NDIR sensors have target sensing ranges of 3250 nm to 3650 nm or 6500 nm to 7650 nm. These ranges are approximate and are generally correlated with key hydrocarbon peaks for detecting hydrocarbon refrigerants. An alternative NDIR sensor is a two-channel sensor with one channel serving the function above and the other channel functioning as a more standard sensor used to sense container interior temperature. An alternative sensor would be a metal oxide sensor or an electrochemical sensor.

Although there may be various hardwired/hardcoded or analog implementations with little control logic, an exemplary implementation involves the detector 232 communicating with a programmed controller (which in turn communicates with the supplemental lock 230. The controller may be the main controller 64 of the refrigeration system or may be a separate unit 234 (FIG. 5, e.g., having a processor, memory and storage for running a program to perform the required functions).

The exemplary supplemental lock 230 interacts with the locking bars of a baseline container configuration. The number of such supplemental locks depends upon the configuration of the doors and the existing latching mechanism. For example, some containers may be configured so that the doors may independently open. In such a situation, at a minimum, one supplemental lock is provided per door to lock at least one of the locking bars of such door. In the exemplary situation, however, one of the doors 28A (FIG. 2) is the dominant door and carries a feature (e.g., a lip) 240 that prevents opening of the other door 28B when the dominant door is closed. In such a situation, the supplemental lock may lock only the dominant door. The exemplary implementation places the supplemental lock 230 as an electronically or electrically actuated mechanism adjacent the existing or baseline catch to supplement the existing catch by locking the handle and/or rod in addition to the latching provided by the catch.

Alternative supplemental locks may replace the existing or baseline catch and serve the function thereof in addition to the safety functions described below.

Figure 6:
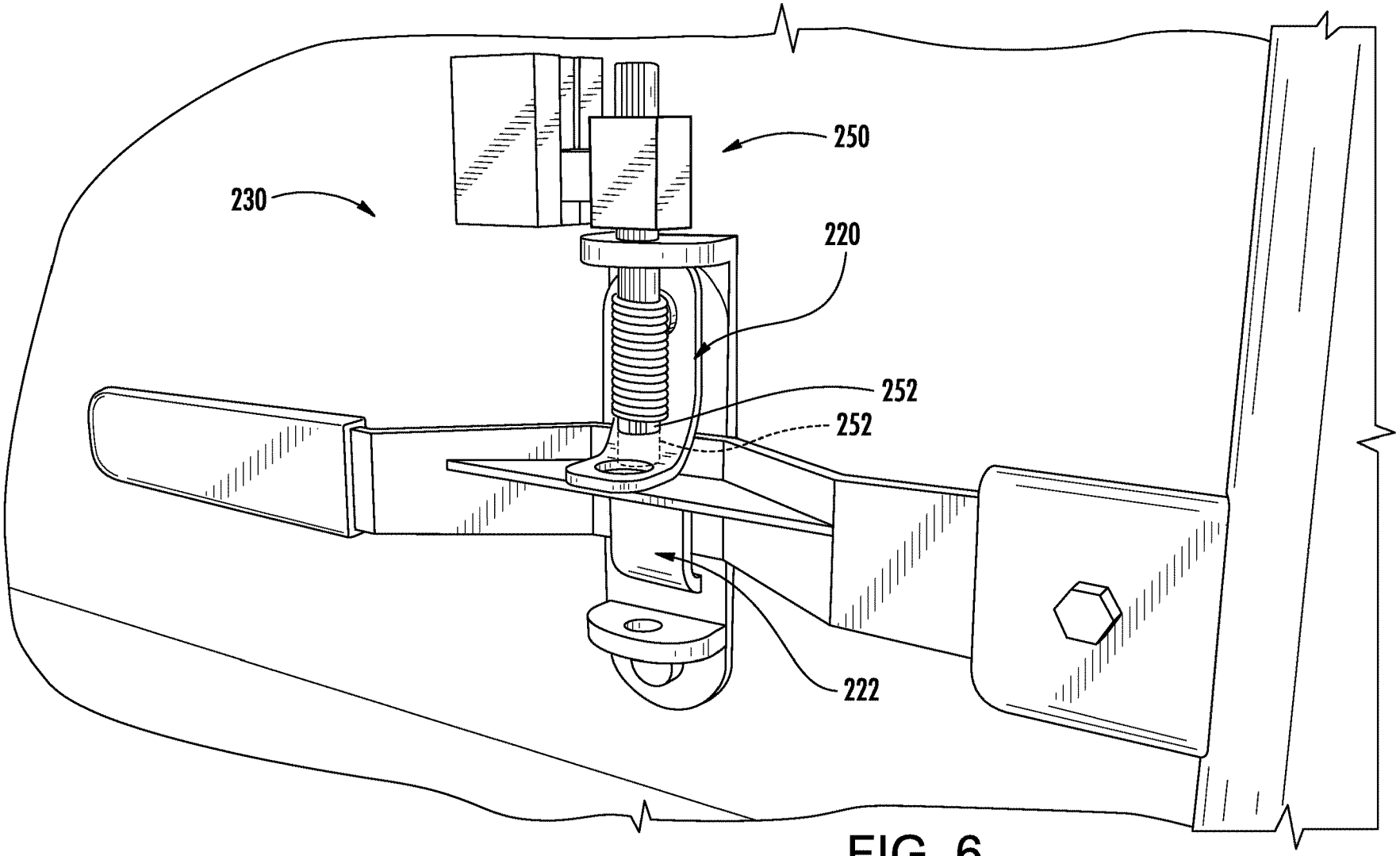
FIG. 6 is a view of a locking handle of a door of the refrigerated cargo container and showing an exterior supplemental locking mechanism.

An exemplary supplemental lock 230 is in wireless communication with the controller (64 or 234) and, therefore, includes its own battery and electronics (e.g., including a wireless receiver) and an actuator 250 (FIG. 6) for shifting a locking member 252 (e.g., a pin) between a locking condition and an unlocking condition (unlocking or retracted shown in solid line in FIG. 6 with locking or extended in broken line). By having its own battery, separate from the main battery 66, operation of the supplemental lock can be assured even if the main battery discharges (as is often the case where the container sits unused and disconnected from external power). For this purpose the battery may be a long life disposable battery such as an alkaline battery. For similar reasons, this battery or similar batteries may power the detector 232, other associated safety equipment, and the controller 234 as is discussed further below.

Exemplary actuators include servomotors or solenoids and may be formed for worm drive, gear drive, linear drive, or the like. An exemplary locking condition is an extended condition extending through apertures in the handle and retainer. An exemplary unlocking condition is a retracted condition.

As a practical matter, the controller is more likely to be in hardwired communication with the detector rather than wireless communication. The controller may conveniently be located in the equipment box in reasonable wiring proximity to a detector in the box. The controller may have its own battery 258 (FIG. 5). Similarly, a detector wirelessly coupled to the controller may have its own battery and radio electronics. There may be multiple detectors coupled to a given controller.

Upon detection of the presence of the refrigerant (or a threshold level thereof) by the detector, the controller may cause the supplemental lock 230 actuator 250 to shift the locking member 252 from its unlocking condition to its locking condition. One or more of several unlocking options are possible, including: unlocking when the detector no longer detects threshold refrigerant; unlocking in response to a user-entered override (e.g., via a switch or control panel). Additionally, an interior safety release may be provided for a user inside.

As a further option, the detection may cause the controller (64 or 234) to command one or more alerts or indicia. One example involves an alert unit 260 (FIG. 2) mounted on the container (e.g., the same door as the supplemental lock (and optionally integrated therewith). The exemplary unit may have a light 262 for visual alert and a speaker or other sound generator or alarm 264 for audio alert. Again, the unit may have its own battery and radio electronics for wireless communication with the controller or may be hardwired.

Yet other systems potentially involve integrating the detector with the supplemental locking mechanism such as for a supplemental locking mechanism mounted in the rear header. Such a system might have a relatively limited controller (e.g., a dedicated controller as distinguished from an overall controller of the refrigeration system).

Figure 7:
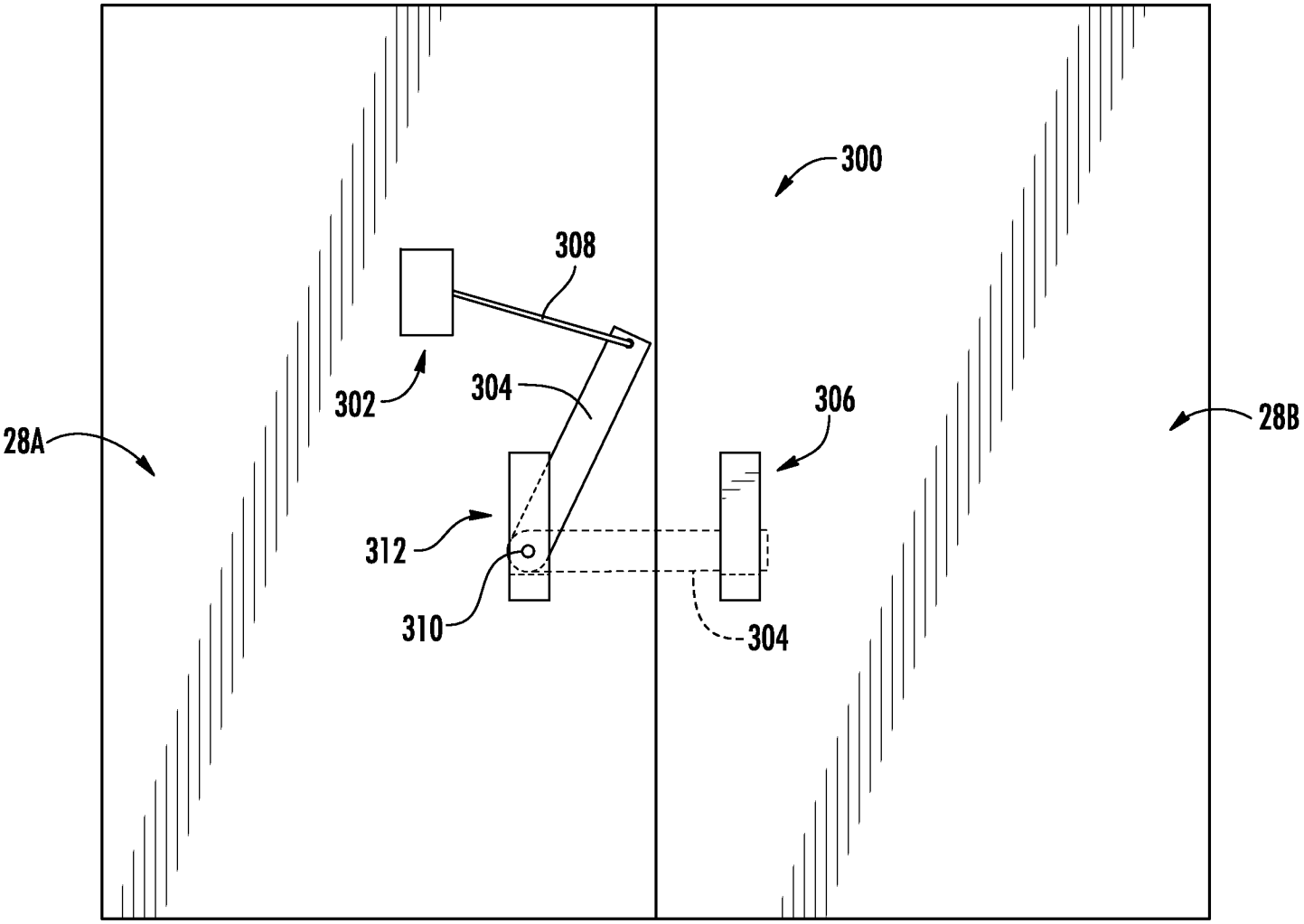
FIG. 7 is an interior view of an alternative door pair of the refrigerated cargo container showing an interior supplemental locking mechanism.

Alternative implementations may have the supplemental lock be independent of the baseline locking bars. For example, one such independent variation (not shown) involves a pair of such supplemental locks locking each door directly to the rear header (or a single lock locking a dominant door to the header). Other exemplary implementations involve a supplemental lock 300 (FIG. 7) for locking the two doors to each other to prevent their opening. The exemplary illustrated example is mounted to the interior of the doors and comprises an actuator assembly 302 and a locking member 304 mounted to one door and a member 306 mounted to the other. The illustrated example has a falling bar locking member with a proximal end portion pivotally mounted to the first door. The actuator may release the locking member, allowing its distal end to rotate downward under the weight of the locking member. The falling locking member is then caught by an upwardly open bracket as the member 306 (e.g., L or U bracket) to lock the two doors to each other (broken line condition). In the illustrated example, the pivot 310 is an axle spanning a similar L or U bracket 312 for strength. An external alert unit 260 (not shown) may also be provided as in the first embodiment.

The exemplary actuator of the assembly 302 comprises an electric motor driving a spool around which a tether (e.g., cable) 308 is wrapped. The tether connects to the locking member. For locking, the controller may cause the motor to unwrap/unwind the tether. For unlocking, the controller may cause the motor to rewind/rewrap the tether to lift the locking member. As with the other embodiments, the actuator assembly may include its own battery, radio, and other electronics.

As a further safety feature, a plurality of valves may be located along the refrigerant flowpaths and may be actuated responsive to the detector detecting refrigerant leakage. The valves allow isolation of sections of the refrigerant flowpaths to limit leakage generally but also particularly limit leakage into the container. For example, a pair of valves 340A; 340B and 341A; 341B (FIG. 3) may be located to isolate the evaporator. The valves may be located just outside of the air flowpaths 510A and 510B (e.g., they may be in the exterior side of the equipment box). In such a situation, if a leak occurs in the evaporator, once the leak is detected essentially no refrigerant from other portions of the system would be able to leak into the container interior. This would limit leakage to a portion of the refrigerant from just one of the two vapor compression systems.

Exemplary valves are normally closed solenoid valves. These may be powered by the main battery of the refrigeration system or by a separate battery. As a practical matter, in operation, the power for such valves may come from the external power (e.g., ship power) or power from a generator as discussed above. Thus, energy consumption while the compressor is running would not be a problem. Again depending upon the implementation, these may be hard-wired to the controller or may be subject to wireless control. Such valves are particular candidates for immediate/direct control by the main controller of the refrigeration system. In situations where separate controllers are involved, the controller 234 may communicate with the main controller of the refrigeration system to shut the refrigeration system down in response to leak detection. Such shutdown would involve shutting down the compressor and, subsequently, closing the valves 340A; 340B and 341A; 341B (or simply allowing them to close).

Yet additional safety features involve the placement of flame arrestors in a number of locations. Background flame arrestor technology which may be utilized is found International Publication No. WO2015/009721A1, published Jan. 22, 2015, the disclosure of which is incorporated herein in its entirety by reference as if set forth at length. One exemplary flame arrestor is one or more woven wire or perforated mesh (e.g., expanded metal mesh) panels 400 (FIG. 4) across openings along the front of the equipment box. This may cover openings to the compressor, heat exchangers, and any piping or other refrigerant carrying components of the vapor compression loops. Mesh opening size will depend on the inherent flammability and expected operating conditions of the particular refrigerant. Other flame arrestor locations include placing such mesh or perforated sheet 402, 404 (FIG. 5) across the internal air flowpath (e.g., in the duct within the equipment box immediately upstream of the fans and another immediately downstream of the evaporators). This would isolate the fans as an ignition source from the bulk of the refrigerated compartment. Similarly, such flame arrestors could be located at the equipment module (box) inlet and outlet to the refrigerated compartment. Additional such flame arrestors would be associated with other ports such as the fresh air exchange vent. Non-metallic and/or non-sheet arrestor materials may also be used. For example, in-duct arrestors are candidates for an HVAC filter (dual purpose filter and flame arrestor) constructed of nonflammable (e.g., glass or steel wool or packed fiber) materials. In duct flows, such devices will create pressure drop (not desirable) and that will need to be considered during design.

As a further safety feature, the detector and controller may be coupled to a ventilation system for venting the interior of the container in response to leak detection. This venting may be done by a dedicated additional venting fan (e.g., along with controllable shutter or other valving). In such a situation, the fan unit would include its own battery and electronics optionally integrated with one of the other components such as the controller, the detector, or the supplemental lock. Alternative implementations may use baseline fresh air exchange vents (e.g., 80A shown above and, its associated blower fan, if any, and/or evaporator fan) to do the venting. For example, one implementation might involve the shutting down of the refrigeration system but the opening of the gate valve 80A and the running of the fan 52A.

Additional use of components to prevent or block sparking or arcing may be provided, including use of known forms of explosion-proof motors. Relevant motors for scrutiny include: the compressor motor; fan motors; and actuator motors. This may include replacing or modifying baseline motors and adding motors associated with features such as supplemental vents, supplemental fans, and the like.

Arcing would be undesirable in motor commutation. Particularly for evaporator fan motors (and other motors in the refrigerated compartment), induction motors would be good choices.

Such a motor may have a totally enclosed frame and be sealed from any vapor penetration, this would include seals to shafts that would drive the fans. All connections to such motors may be sealed from any vapor penetration. This sealing would include the conduit via which wire enters the motor connection box Totally hermetic heaters would be used along the recirculating flowpaths (used for evaporator defrost and heating when external temperatures are so low that the compartment must be heated rather than cooled). Thus, any failure mode would not result in an electrical arc.

Some-to-all electrical interconnections (wire, cable) may be sealed in exposition proof conduit. All penetrations in or out the evaporator side of the equipment module would be explosion proof (no vapor penetration).

Some-to-all sensors may be sealed from vapor penetration so that any failure mode would not result in an electrical arc in a location of possible refrigerant exposure. In addition to sensors associated with the detector(s) 230 or other non-baseline components, this may include sensors of the baseline module. Exemplary baseline sensors include the DTS (defrost termination sensor) on the evaporator coil, HTT (high temperature termination sensor) on the evaporator coil and temperature measurement sensor located slightly downstream of the evaporator.

As noted above, when mildly flammable refrigerants are used, reduced mitigation is appropriate. Mitigation can be concentrated on the container interior (where concentration effects may be a problem even for mildly flammable refrigerants). The detector 230, supplemental lock, venting blowers (whether added or part of the baseline) and their associated control and powering aspects would be most likely included. Then, interior passive measures are also likely such as: sealing the interior of the equipment module from the exterior; jacketing or otherwise sealing electrical/electronic lines and components from sparking/arcing; interior flame arrestors; interior explosion-proof motors and the like. Also the valves 340A, 340B, 341A, 341B may be included. Exterior measures such as exterior flame arrestors, exterior anti-spark conduits and sealing, and exterior explosion-proof motors could be avoided due to the reduced flammability and reduced charge per loop.

The system may be made using otherwise conventional or yet-developed materials and techniques.

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing basic refrigeration system and/or container construction and associated use methods, details of such existing configuration or its associated use may influence details of particular implementations. Accordingly, other embodiments are within the scope of the following claims.

What is claimed is:

1. A refrigerated transport system comprising:

a body (22) enclosing a refrigerated compartment and comprising:

a pair of side walls (22C, 22D);

a top (22A);

a bottom (22B); and one or more doors (28A, 28B); and a refrigeration system (29) comprising:

a first vapor compression loop (30A) having:

a refrigerant charge;

a compressor (36A) for driving the refrigerant of the refrigerant charge;

a first heat exchanger (38A) positioned to reject heat to an external environment in a cooling mode; and a second heat exchanger (42A) positioned to absorb heat from the refrigerated compartment in the cooling mode; and a second vapor compression loop (30B) having:

a refrigerant charge;

a compressor (36B) for driving the refrigerant of the refrigerant charge;

a first heat exchanger (38B) positioned to reject heat to an external environment in a cooling mode;

a second heat exchanger (42B) positioned to absorb heat from the refrigerated compartment in the cooling mode; and for each of the first vapor compression loop and the second vapor compression loop:

an electric fan (52A, 52B) positioned to drive a recirculating air flow from the refrigerated compartment across the second heat exchanger of said vapor compression loop but not the other of the first vapor compression loop and the second vapor compression loop, wherein:

the one or more doors are at a first end of the body;

the refrigeration system is mounted in an equipment box at a second end of the body opposite the first end, the equipment box containing, the first heat exchanger and the second heat exchanger of the first vapor compression loop and the first heat exchanger and the second heat exchanger of the second vapor compression loop; and the refrigerated compartment is a single refrigerated compartment between the first end and the second end.

2. The refrigerated transport system of claim 1 wherein the recirculating air flows of the respective fans are in parallel.

3. The refrigerated transport system of claim 1 wherein for each of the first vapor compression loop and the second vapor compression loop:

the refrigerant charge of the vapor compression loop is mildly flammable.

4. The refrigerated transport system of claim 1 wherein for each of the first vapor compression loop and the second vapor compression loop:

the refrigerant charge of the vapor compression loop comprises at least 50% by weight one or a combination of R-1234ze(E), R-32, R-1234yf.

5. The refrigerated transport system of claim 1 wherein for each of the first vapor compression loop and the second vapor compression loop:

the refrigerant charge of the vapor compression loop comprises at least 30% by weight one of R-1234ze(E), R-32, R-1234yf.

6. The refrigerated transport system of claim 1 wherein for each of the first vapor compression loop and the second vapor compression loop:

the refrigerant charge of the vapor compression loop comprises at least 50% by weight one of R-1234ze(E), R-32, R-1234yf.

7. The refrigerated transport system of claim 1 wherein for each of the first vapor compression loop and the second vapor compression loop:

the refrigerant charge has a mass of not more than 2.0 kg.

8. The refrigerated transport system of claim 1 wherein:

the first vapor compression loop and the second vapor compression loop are not in refrigerant communication with each other.

9. The refrigerated transport system of claim 1 further comprising:

a single generator (60) powering the compressor of the first vapor compression loop and the compressor of the second vapor compression loop.

10. The refrigerated transport system of claim 1 further comprising:

a detector (232) for detecting leakage of the refrigerant.

11. The refrigerated transport system of claim 10 further comprising:

a locking mechanism (230; 300) having a first condition locking the one or more doors and a second condition allowing opening of the one or more doors and coupled to the detector.

12. The refrigerated transport system of claim 11 wherein:

the locking mechanism is coupled to the detector to shift from the second condition to the first condition responsive to detection by the detector of the refrigerant outside the first vapor compression loop and the second vapor compression loop.

13. The refrigerated transport system of claim 10 further comprising one or both of:

an externally visible light (262) coupled to the detector; and an externally audible alarm (264) coupled to the detector.

14. The refrigerated transport system of claim 10 further comprising:

a battery-powered ventilation fan.

15. The refrigerated transport system of claim 10 further comprising for each of the first vapor compression loop and the second vapor compression loop:

another electric fan (50A, 50B) positioned to drive an air flow across the first heat exchanger.

16. The refrigerated transport system of claim 10 wherein:

the detector comprises a non-dispersive infrared sensor.

17. The refrigerated transport system of claim 10 being a refrigerated intermodal shipping container wherein:

the one or more doors comprise a pair of hinged doors at the first end of the body.

18. The refrigerated transport system of claim 10 further comprising:

a controller coupled to the detector so as to, responsive to said detecting leakage of the refrigerant, at least one of:

vent the refrigerated compartment;

lock at least one door of the one or more doors;

isolate a portion of at least one of the first vapor compression loop and the second vapor compression loop; and provide an audible and/or visible indication of the detection.

19. A method for operating the refrigerated transport system of claim 1, the method comprising:

responsive to said detecting leakage of the refrigerant, at least one of:

venting the refrigerated compartment;

locking at least one door of the one or more doors;

isolating a portion of at least one of the first vapor compression loop and the second vapor compression loop; and providing an audible and/or visible indication of the detection.

* * * * *